US006440908B2

(12) United States Patent
Racherla

(10) Patent No.: US 6,440,908 B2
(45) **Date of Patent: *Aug. 27, 2002**

(54) HIGH MOISTURE RETAINING BARS COMPOSITIONS COMPRISING BORAX AS WATER STRUCTURANT

(75) Inventor: Uday Shanker Racherla, West Caldwell, NJ (US)

(73) Assignee: Unilever Home & Personal Care USA, division of Conopco, Inc., Greenwich, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/449,895

(22) Filed: Nov. 30, 1999

(51) Int. Cl.[7] ..... C11D 9/00; C11D 1/83; C11D 3/04

(52) U.S. Cl. ..... 510/122; 510/123; 510/127; 510/150; 510/152; 510/153; 510/155; 510/156; 510/446; 510/447; 510/450; 510/451

(58) Field of Search ..... 510/120, 122, 510/123, 127, 150, 152, 153, 155, 156, 446, 447, 450, 451

(56) References Cited

U.S. PATENT DOCUMENTS

| | | | | |
|---|---|---|---|---|
| 3,708,425 A | | 1/1973 | Compa et al. | |
| 3,723,325 A | | 3/1973 | Parran, Jr. | |
| 3,798,181 A | | 3/1974 | Vazquez | |
| 4,707,289 A | * | 11/1987 | Ramachandran et al. | 252/135 |
| 5,009,814 A | | 4/1991 | Kelkenberg et al. | |
| 5,043,091 A | * | 8/1991 | Joshi et al. | 252/174.17 |
| 5,389,279 A | | 2/1995 | Au et al. | |
| 5,952,289 A | * | 9/1999 | Wise et al. | 510/450 |

FOREIGN PATENT DOCUMENTS

| | | |
|---|---|---|
| EP | 0556957 | 8/1993 |
| GB | 2186883 | 4/1991 |
| WO | 98/54285 | 12/1998 |

* cited by examiner

*Primary Examiner*—Gregory Delcotto
(74) *Attorney, Agent, or Firm*—Ronald A. Koatx

(57) ABSTRACT

The subject invention involves high moisture containing bar compositions comprising required amounts of a borate compound. The borate compound structures water in the bar thereby enabling the retention of high amounts of moisture without compromising bar properties.

5 Claims, No Drawings

HIGH MOISTURE RETAINING BARS COMPOSITIONS COMPRISING BORAX AS WATER STRUCTURANT

FIELD OF THE INVENTION

The present invention relates to bar compositions comprising Borax as water structurant, particularly toilet soaps made by milling, plodding and stamping, wherein the water content of the said bars can be significantly increased and retained in the bar, without introducing process related problems and while maintaining good user attributes (e.g., hardness, rate of wear, lather, mush etc.). Thus, these high moisture retaining bar compositions containing Borax enable significant cost savings because of the replacement of total fatty matter (TFM) with water.

BACKGROUND OF THE INVENTION

Conventional toilet soaps are normally composed of predominantly soap (e.g., >70% TFM), 10–13% water and the usual additives (e.g., soda, salt, dyes and perfumes). These bars are typically produced by mixing soap and/or other synthetic surfactants with useful additives, followed by milling, plodding and stamping.

The subject invention is concerned with high moisture containing, low cost Borax soap bars, in which soap constitutes the majority if not all of the surfactant system, although it will be understood that any surfactant system may be used in place of soap. Such bars may also comprise one or more filler materials such as, for example, talc.

In low cost toilet soaps, TFM is generally the most expensive ingredient. Since the level of TFM needed for acceptable detergency is much lower than what is used in conventional toilet soaps, it is desirable to replace TFM with water, air or cheaper fillers, while retaining processability and good bar properties.

As noted, one plausible route to reducing cost is to replace TFM with water. Typically, however, incorporating higher levels of water (e.g., ≧15% and particularly ≧20%) introduces many process and product related problems. Process related problems include production of soft soap masses that are difficult to mill, plod and stamp. Further, even if one were to succeed in avoiding process related problems, high levels of water are difficult to retain in the bar due to enhanced water activity, indicating free water that will be lost, bringing the equilibrium moisture level down to same level as in conventional soaps. Thus, significant losses of moisture from the bars leads to product related problems such as volume shrinkage, cracking and high rates of wear. Accordingly, moisture retention in a high moisture containing toilet bar requires water to be immobilized, which is difficult to achieve under low cost scenario. For this reason, soap bars sold in many developing countries typically contain only 12–13% moisture.

Unexpectedly, applicants have now discovered that by using required amounts of borate compounds (e.g., Borax, calcium borate, calcium-magnesium borate, sodium calcium borate) and/or boric acid ("puffed" Borax as described in U.S. Pat. No. 3,708,425 is generally not the type of boron compound contemplated for use in the bars of the subject invention) as water structurant/filler, it is possible to not only incorporate but also retain much higher amounts of water than previously possible, while maintaining good processability and good bar properties.

The use of borate compounds or boric acid in personal care products generally is not new. As described in a Service Bulletin from Borax Company, borates have been used in many personal care products including soaps (see Section 2.2 of bulletin).

When previously used with soaps, however, Borax has been used as a soluble scrubber in powdered hand soap compositions of the type used to clean medium to heavy soils found in industrial operations; or in liquid soaps (page 5 of Bulletin, first full paragraph).

Borates were also used in the production of laundry soap chips (discontinued in 1960's) or as a constituent of a multi-component enzyme stabilization system. Two examples of borate used as part of an enzyme stabilization system are GB 2,186,833 (Unilever) and WO 98/54285 (Procter & Gamble).

However, both these examples contain enzymes which are undesirable for personal wash applications (bars of the subject invention contain no enzymes). Further, without fillers (e.g., talc), these compositions are said to be soft and doughy (see page 16, lines 12–14 of WO 98/54285) and, even with fillers, applicants have found these compositions to be much softer compared to those of the subject invention (e.g., 8 or below, preferably below 7, more preferably below 6).

Further, these bars of the art require cooling tunnels to achieve even the levels of hardness they possess, which increases the cost of their production. The subject invention uses no such cooling tunnels to achieve hardness.

U.S. Pat. No. 3,708,425 to Compa et al. teaches a detergent bar containing about 5 to 60% by wt. puffed Borax. This work specifically calls for puffed Borax or other puffed salts to which the user properties of the bar are attributed. The puffed Borax is compositionally different than Borax or other boron-containing compounds of the invention.

U.S. Pat. No. 3,798,181 to Vazquez teaches enzymatic detergent bars (not pure soap bars) containing 10–40% synthetic detergent, 0.5–5% enzymes, 5–40% binder (e.g., to help retain water), 20–60% inorganic builder and 12–25% water. Borax may be used as possible inorganic builder. The bar is a detergent bar which contains enzymes unlike bars of the invention which contain no enzymes.

Finally, none of the prior art teaches Borax as a water structurant which enables not only the incorporation but even the retention of high amounts of water in the bar.

BRIEF SUMMARY OF THE INVENTION

The present invention relates to personal wash bar compositions containing surfactant (preferably, at least 30% of the surfactant system is anhydrous soap); borate compound, greater than 0.1 to 25%, preferably 0.5 to 20%, more preferably 1 to 18%, preferably not including puffed Borax (composition may comprise lower levels of 2%, 3% or 4% Borax as well); water, at least about 20 to 60%, more preferably 20 to 50%, more preferably 24 to 40%, most preferably 24 to 35%; wherein the borate compound, preferably without any other binder, is structuring water at high levels to provide bar with hardness (expressed as penetration value) of less than or equal to 8 (measured using penetrometer) more preferably less than or equal to 7, more preferably 4–6 and wherein said bars are made by conventional milling, plodding and stamping.

More specifically, the invention comprises an enzyme-free personal wash bar composition comprising:

(a) 30% to 70%, preferably 40% to 60% by wt. of a surfactant selected from the group consisting of fatty acid soap, anionic surfactant other than soap, amphoteric surfactants, nonionic surfactant and mixtures thereof;

(b) greater than 0.1% to 25% by wt. of a borate compound (e.g., Borax, calcium borate, sodium calcium borate, calcium magnesium borate, boric acid, etc.);

(c) about 20% to 60% by wt. water;

wherein said bar has hardness expressed as penetration value of less than or equal to 8 as measured by penetrometer; and wherein said bar is made using a step in which ingredients used to form said bar are mixed, milled, plodded and stamped.

DETAILED DESCRIPTION OF THE INVENTION

The present invention relates to high moisture containing bars, preferably bar soaps containing 30% to 100% of surfactant system of fatty acid soaps and made by conventional milling, plodding and stamping route. Generally, it is difficult to introduce let alone retain, large amounts of water into soap bars (e.g., moisture levels greater than 20% to 60%, preferably 20% to 50%, more preferably 24% to 40%, most preferably 24% to 35%) without introducing process and product related problems.

Unexpectedly, applicants have now discovered that borate compounds (including boric acid) can be used to structure water, thereby allowing the incorporation as well as retention of large amounts of water in the bar (in place of, for example, more expensive fatty acid soap) and without need of costly structurants or binders. Thus, the borate compound or mixture of compounds allows production of bars having hardness expressed as penetration value of less than or equal to 8, preferably less than or equal to 7, more preferably 4 to 6 using penetrometer tests.

Each of the ingredients in this composition is set forth with more particularity below:

Surfactant

Bar compositions of the invention preferably comprise surfactant system in which at least 30% to 100%, more preferably 50% to 100%, more preferably 70% to 100% and most preferably the entire 100% of surfactant system comprises fatty acid soap.

The balance of the surfactant system may be a surfactant selected from the group of surfactants, comprising of anionic surfactant (other than soap) nonionic, amphoteric/zwitterionic and mixtures thereof.

The anionic detergent active which may be used may be aliphatic sulfonates, such as a primary alkane (e.g., $C_8$–$C_{22}$) sulfonate, primary alkane (e.g., $C_8$–$C_{22}$) disulfonate, $C_8$–$C_{22}$ alkene sulfonate, $C_8$–$C_{22}$ hydroxyalkane sulfonate or alkyl glyceryl ether sulfonate (AGS); or aromatic sulfonates such as alkyl benzene sulfonate.

The anionic may also be an alkyl sulfate (e.g., $C_{12}$–$C_{18}$ alkyl sulfate) or alkyl ether sulfate (including alkyl glyceryl ether sulfates). Among the alkyl ether sulfates are those having the formula:

$$RO(CH_2CH_2O)_nSO_3M$$

wherein R is an alkyl or alkenyl having 8 to 18 carbons, preferably 12 to 18 carbons, n has an average value of greater than 1.0, preferably greater than 3; and M is a solubilizing cation such as sodium, potassium, ammonium or substituted ammonium. Ammonium and sodium lauryl ether sulfates are preferred.

The anionic may also be alkyl sulfosuccinates (including mono- and dialkyl, e.g., $C_6$–$C_{22}$ sulfosuccinates); alkyl and acyl taurates, alkyl and acyl sarcosinates, sulfoacetates, $C_8$–$C_{22}$ alkyl phosphates and phosphates, alkyl phosphate esters and alkoxyl alkyl phosphate esters, acyl lactates, $C_8$–$C_{22}$ monoalkyl succinates and maleates, sulphoacetates, alkyl glucosides and acyl isethionates.

Particularly preferred are the $C_8$–$C_{18}$ acyl isethionates. These esters are prepared by reaction between alkali metal isethionate with mixed aliphatic fatty acids having from 6 to 18 carbon atoms and an iodine value of less than 20. At least 75% of the mixed fatty acids have from 12 to 18 carbon atoms and up to 25% have from 6 to 10 carbon atoms.

When used, the term "fatty acid soap" is used in its popular sense, i.e., alkalimetal or alkanol ammonium salt of aliphatic alkane or alkene monocarboxylic acids. Sodium, potassium, mono-, di- and triethanol ammonium cations, or combinations thereof, are suitable for purposes of the invention. Generally, sodium soaps are used. Soaps useful herein are the well known alkali metal salts of natural or synthetic aliphatic (alkanoic or alkenoic) acids having 13 to 22 cations, preferably 12 to 18. They may be described as alkali metal carboxylates of acrylic hydrocarbons having about 12 to 22 carbons.

Amphoteric surfactants which may be used in this invention include at least one acid group. This may be a carboxylic or a sulphonic acid group. They include quaternary nitrogen and therefore are quaternary amido acids. They should generally include an alkyl or alkenyl group of 7 to 18 carbon atoms. They will usually comply with an overall structural formula:

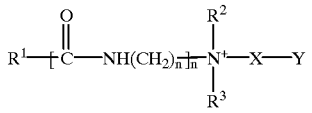

where $R^1$ is alkyl or alkenyl of 7 to 18 carbon atoms;

$R^2$ and $R^3$ are each independently alkyl, hydroxyalkyl or carboxyalkyl of 1 to 3 carbon atoms;

m is 2 to 4;

n is 0 to 1;

X is alkylene of 1 to 3 carbon atoms optionally substituted with hydroxyl, and

Y is $—CO_2—$ or $—SO_3—$

A further possibility is that the amphoteric detergent is a sulphobetaine of formula:

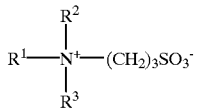

or

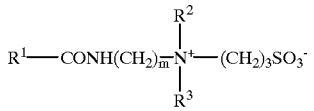

where m is 2 or 3, or variants of these in which $—(CH_2)_3SO_3^-$ is replaced by

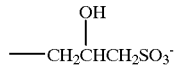

In these formulae $R^1$, $R^2$ and $R^3$ are as discussed previously.

The nonionics which may be used include in particular the reaction products of compounds having a hydrophobic group and a reactive hydrogen atom, for example aliphatic alcohols, acids, amides or alkylphenois with alkylene oxides, especially ethylene oxide either alone or with propylene oxide. Specific nonionic detergent compounds are alkyl ($C_6$–$C_{22}$) phenols ethylene oxide condensates, the condensation products of aliphatic ($C_8$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

The nonionic may also be a sugar amide, such as a polysaccharide amide. Specifically, the surfactant may be one of the lactobionamides described in U.S. Pat. No. 5,389,279 to Au et al. which is hereby incorporated by reference or it may be one of the sugar amides described in U.S. Pat. No. 5,009,814 to Kelkenberg, hereby incorporated into the subject application by reference.

Examples of cationic detergents are the quaternary ammonium compounds such as alkyldimethylammonium halogenides.

Other surfactants which may be used are described in U.S. Pat. No. 3,723,325 to Parran Jr. and "Surface Active Agents and Detergents" (Vol. I & II) by Schwartz, Perry & Berch, both of which are also incorporated into the subject application by reference.

Borate Compounds

The compound or compounds of the invention is typically a borate (e.g., Borax) containing boron.

More specifically, boron does not occur in elemental form in nature but is typically found combined with oxygen, sodium, and calcium. Traces of boron salts are present in rocks, soil, and water almost everywhere; however, large deposits of borate minerals are comparatively rare and exist in only a few places in the earth's crust.

The oldest and most plentiful form of boron known to man is the mineral salt Tincal (sodium tetraborate decahydrate, or simply, Borax). Other borate minerals that occur naturally and are mined commercially include Colemanite (calcium borate), Hydroboracite (calcium-magnesium borate), Kernite (sodium borate), and Ulexite (sodium-calcium borate).

In addition to being naturally mined, materials can be made from others. Thus for example, boric acid (Sassolite) can also be chemically made from Tincal (Borax), Kernite as well as many other borate ores.

The boron compound can be any of these borate minerals (e.g., sodium tetraborate decahydrate, calcium borate, calcium-magnesium borate, sodium borate etc), boric acid or mixtures of the two.

The table below lists a variety of borate compounds that can be used in the subject invention.

TABLE 1

Borate compounds suitable for water structuring in low cost bars.

| Name | Structure |
|---|---|
| Tincal | $Na_2B_4O_7.10\ H_2O$ |
| Tincalonite | $Na_2B_4O_7.5\ H_2O$ |
| Kernite | $Na_2B_4O_7.4\ H_2O$ |
| Colemanite | $Ca_2B_6O_{11}.5\ H_2O$ |
| Ulexite | $Na_2Ca_2B_{10}O_{18}.16\ H_2O$ |
| Proberite | $Na_2Ca_2B_{10}O_{18}.10\ H_2O$ |
| Hydroboracite | $CaMgB_6O_{11}.6\ H_2O$ |
| Inderite | $Mg_2B_6O_{11}.15\ H_2O$ |
| Dalotite | $Ca_2Si_2B_2O_9.H_2O$ |
| Szaibelyite | $Mg_2B_2O_5.H_2O$ |
| Sassolite | $B(OH)_3$ |

Typically, the borate compound or compounds will comprise 0.1 to 25%, preferably 0.5% to 20% by wt., more preferably 1 to 18% of the bar compositions. It may comprise 2%, 3% or 4% minimum levels.

What is unique to the invention was the discovery that these boron compounds structure large amounts of water, preferably in the absence of binders and structurants normally found in bars, which allowed for replacement of surfactant (e.g., TFM) and production of less expensive bars.

The boron containing compound is preferably not the "puffed" Borax compound described in U.S. Pat. No. 3,708,425 which is chemically a distinct compound prepared by heating disodium tetraborate decahydrate ($Na_2B_4O_7$ 10 $H_2O$) or the pentahydrate to 200–450° F. to dry and than to 600–800° F. to cause the material to swell/aerate ("puffing").

Water

As noted, a key to the invention was the observation that the boron compound allowed much greater quantities of water to be structured without introducing process problems and while retaining good bar user attributes (e.g., good hardness, i.e., less than or equal to 8).

Typically, bars of the invention comprise at least 20–60% by wt. moisture, preferably at least 20% to 50%, more preferably 24% to 40%, more preferably 24% to 35%.

Additives

Additives such as dyes, perfumes, soda ash, sodium chloride, brighteners, etc. are normally used in an amount 0 to 3%, preferably 0.01 to 2% of the composition. Some examples are set forth below.

Perfumes; sequestering agents, such as tetrasodium ethylenediaminetetraacetate (EDTA), EHDP or mixtures in an amount of 0.01 to 1%, preferably 0.01 to 0.05%; and coloring agents, opacifiers and pearlizers such as zinc stearate, magnesium stearate, $TiO_2$, EGMS (ethylene glycol monostearate) or Lytron 621 (Styrene/Acrylate copolymer); all of which are useful in enhancing the appearance or cosmetic properties of the product.

In addition, the bar compositions of the invention may include 0 to 25% by wt., preferably 1 to 25% by wt., more preferably 5 to 20% by wt. skin protection and benefit agents and/or performance enhancers optional ingredients as follows:

Further, the bar composition of the invention may include 0–25% by weight of crystalline or amorphous aluminium hydroxide. The said aluminium hydroxide can be generated in-situ by reacting fatty acids and/or non-fatty mono- or polycarboxylic acids with sodium aluminate, or can be prepared separately by reacting fatty acids and/or non-fatty mono- or polycarboxylic acids with sodium aluminate and adding the reaction product to the soap.

Such optional additives may include polyalkylene glycol of MW 2000 to 20,000; starches; water soluble polymers chemically modified with hydrophobic moiety (e.g., EO—PO block copolymer).

Other optional additives may include one or more of structurants such as soluble alkaline silicate, kaolin, talc, inorganic electrolytes such as tetra sodium pyrophosphate, organic salts such as sodium citrate, sodium acetate, and modified starches.

Optionals may further include antimicrobials such as 2-hydroxy4,2'4' trichlorodiphenylether (DP300); preservatives such as dimethyloldimethylhydantoin (Glydant XL1000), parabens, sorbic acid etc.

The compositions may also comprise coconut acyl mono- or diethanol amides as suds boosters, and strongly ionizing salts such as sodium chloride and sodium sulfate may also be used to advantage.

Antioxidants such as, for example, butylated hydroxytoluene (BHT) may be used advantageously in amounts of about 0.01% or higher if appropriate.

Cationic polymers as conditioners which may be used include Quatrisoft LM-200 Polyquaternium-24, Merquat Plus 3330—Polyquaternium 39; and Jaguar® type conditioners.

Polyethylene glycols as conditioners which may be used include:

| | | |
|---|---|---|
| Polyox | WSR-205 | PEG 14M, |
| Polyox | WSR-N-60K | PEG 45M, or |
| Polyox | WSR-N-750 | PEG 7M. |

Another ingredient which may be included are exfoliants such as polyoxyethylene beads, walnut shells and apricot seeds.

Benefit Agent

The benefit agent optionals of the subject invention may be a single benefit agent component, or it may be a benefit agent compound added via a carrier into the process stream. Further the benefit agent may be a mixture of two or more compounds, one or all of which may have a beneficial aspect. In addition, the benefit agent itself may act as a carrier for other components one may wish to add to the bar composition.

The benefit agents can be emollients, moisturizers, anti-aging agents, skin-toning agents, skin lightening agents, sun screens etc., The preferred list of benefit agents include:

(a) silicone oils, gums and modifications thereof such as linear and cyclic polydimethylsiloxanes; amino, alkyl alkylaryl and aryl silicone oils;

(b) fats and oils including natural fats and oils such as jojoba, soybean, rice bran, avocado, almond, olive, sesame, persic, castor, coconut, mink oils; cacao fat; beef tallow, lard; hardened oils obtained by hydrogenating the aforementioned oils; and synthetic mono, di and triglycerides such as myristic acid glyceride and 2-ethylhexanoic acid glyceride;

(c) waxes such as carnauba, spermaceti, beeswax, lanolin and derivatives thereof;

(d) hydrophobic plant extracts;

(e) hydrocarbons such as liquid paraffins, vaseline, microcrystalline wax, ceresin, squalene, pristan and mineral oil;

(f) higher fatty acids such as lauric, myristic, palmitic, stearic, behenic, oleic, linoleic, linolenic, lanolic, isostearic and poly unsaturated fatty acids (PUFA);

(g) higher alcohols such as lauryl, cetyl, stearyl, oleyl, behenyl, cholesterol and 2-hexydecanol alcohol;

(h) esters such as cetyl octanoate, myristyl lactate, cetyl lactate, isopropyl myristate, myristyl myristate, isopropyl palmitate, isopropyl adipate, butyl stearate, decyl oleate, cholesterol isostearate, glycerol monostearate, glycerol distearate, glycerol tristearate, alkyl lactate, alkyl citrate and alkyl tartrate;

(i) essential oils such as mentha, jasmine, camphor, white cedar, bitter orange peel, ryu, turpentine, cinnamon, bergamot, citrus unshiu, calamus, pine, lavender, bay, clove, hiba, eucalyptus, lemon, starflower, thyme, peppermint, rose, sage, menthol, cineole, eugenol, citral, citronelle, borneol, linalool, geraniol, evening primrose, camphor, thymol, spirantol, penene, limonene and terpenoid oils;

(j) lipids such as cholesterol, ceramides, sucrose esters and pseudo-ceramides as described in European Patent Specification No. 556,957;

(k) vitamins such as vitamin A and E, and vitamin alkyl esters, including those vitamin C alkyl esters;

(l) sunscreens such as octyl methoxyl cinnamate (Parsol MCX) and butyl methoxy benzoylmethane (Parsol 1789);

(m) phospholipids; and (n) mixtures of any of the foregoing components.

A particularly preferred benefit agent is silicone, preferably silicones having viscosity greater than about 50,000 centipoise. One example is polydimethylsiloxane having viscosity of about 60,000 centistokes.

Another preferred benefit agent is benzyl laurate.

The benefit agent generally comprises about 0–25% by wt. of the composition, preferably 5–20%.

Processing

The bars of the invention are made typically from a mixture obtained by mixing soap/surfactant base with all the desired ingredients (see examples 1–7) in a ploughshare or Paterson mixer at about 85° C. The mixture is typically cooled to room temperature, aged, milled, plodded and stamped.

Bar Properties

The resulting bar will typically have a hardness expressed as penetration value (less is the penetration value higher is the hardness) of less than or equal to 8, preferably less than or equal to 7, more preferably at least 4 to 7 as measured by penetrometer test.

Typically, bars have density of about 0.8 to 1.3 g/cm$^3$. One significant advantage of the invention is that it allows incorporation of filler such as talc without significantly affecting the bar density.

Bars have low rates of water by which is meant the bar typically has excellent moisturize retention and relatively low amounts of shrinkage both upon stamping and upon use.

Typically, the bars will retain about 85% to 95% of moisture at ambient temperatures and at varying relative humidities (e.g., 55–95% relative humidity).

Typically bars also will have low "mush" values and low cracking scores as well as lather properties comparable to other toilet soaps.

Protocol

This method of measuring bar hardness is performed quite simply by first placing a bar on a sturdy flat surface. The penetrometer is a long cylindrical-like instrument containing at the top a gauge (for measuring in millimeters and hundredth of millimeters) and in the middle a release level which, when released, releases a penetrating cone from the base. The penetrometer is grasped firmly in one hand and its base is placed on the bar surface. When steady, the release lever is to be pushed in and then to the left in one smooth motion. This will allow the pointed penetration cone to drop into the bar surface. The instrument is to be held steadily in place for two minutes. After the two minutes has elapsed, the gauges on the top of the instrument are read. This reading is the number of millimeters that the tip of the cone has penetrated after two minutes (e.g.,—small gauge reads 4, large gauge reads 0.27—this reflects that the cone has penetrated 4.27 mm over the two minute measurement).

To improve steadiness, the penetrometer can be clamped in position prior to pressing the release lever. After the reading is collected, the tip of the penetration cone is wiped off, the instrument inverted (the penetration cone will slide back inside) and the release lever is pushed back to the right (to lock the cone in place). At least two readings should be collected from each bar. Measurements are routinely expressed as mm/2 min. (lower readings=harder bars).

Except in the operating and comparative examples, or where otherwise explicitly indicated, all numbers in this description indicating amounts or ratios of materials or conditions or reaction, physical properties of materials and/or use are to be understood as modified by the word "about".

Where used in the specification, the term "comprising" is intended to include the presence of stated features, integers, steps, components, but not to preclude the presence or addition of one or more features, integers, steps, components or groups thereof.

The following examples are intended to further illustrate the invention and are not intended to limit the invention in any way.

Unless indicated otherwise, all percentages are intended to be percentages by weight.

EXAMPLES

The following 7 compositions were prepared as examples of bars of the invention.

Example 1 - 58% TFM, 3.7% AB, *7% Talc, 24% Moisture

| Ingredient | % by Wt. |
|---|---|
| Anhydrous Soap** | 63 |
| AB* | 3.7 |
| Talc | 7.0 |
| EDTA | 0.04 |
| EHDP | 0.2 |
| $TiO_2$ | 0.1 |
| NaCl | 0.5 |
| Na Carbonate | 0.7 |
| Dye & Perfume | ~0.6 |
| Total Moisture | 24 |

*AB = Anhydrous Borax ($Na_2B_4O_7$).
**82/18 Soap

Example 2 - 55% TFM, 5.3% AB, *5% Talc, 28% Moisture

| Ingredient | % by Wt. |
|---|---|
| Anhydrous Soap** | 60 |
| AB* | 5.3 |
| Talc | 5 |
| EDTA | 0.04 |
| EHDP | 0.2 |
| Titanium Dioxide | 0.1 |
| Sodium Chloride | 0.5 |
| Sodium Carbonate | 0.7 |
| Dye & Perfume | ~0.6 |
| Total Moisture | 28 |

*AB = Anhydrous Borax ($Na_2B_4O_7$).
**82/18 Soap (tallow/coconut).

Example 3 - 51% TFM, 9.54% AB, *0% Talc, 33% Moisture

| Ingredient | % by Wt. |
|---|---|
| Anhydrous Soap** | 56 |
| AB* | 9.54 |
| Talc | 0 |
| EDTA | 0.04 |
| EHDP | 0.2 |
| Titanium Dioxide | 0.1 |
| Sodium Chloride | 0.5 |
| Sodium Carbonate | 0.7 |
| Dye & Perfume | ~0.6 |
| Total Moisture | 33 |

*AB = Anhydrous Borax ($Na_2B_4O_7$).
**82% tallow and 18% coconut.

Example 4 - 47% TFM, 9.54% AB, *2% Sodium Lactate, 35% Moisture

| Ingredient | % by Wt. |
|---|---|
| Anhydrous Soap** | 51 |
| AB* | 9.54 |
| Talc | 0 |
| Sodium Lactate | 2.0 |
| EDTA | 0.04 |
| EHDP | 0.2 |
| $TiO_2$ | 0.1 |
| NaCl | 0.5 |
| $Na_2CO_3$ | 0.7 |
| Dye & Perfume | ~0.6 |
| Total Moisture | 35 |

*AB = Anhydrous Borax ($Na_2B_4O_7$).
**82/18 Soap

Example 5 - 49% TFM, 9.54% AB, *2% Glycerol, 33% Moisture

| Ingredient | % by Wt. |
|---|---|
| Anhydrous Soap** | 51 |
| AB* | 9.54 |
| Talc | 0 |
| Glycerol | 2.0 |
| EDTA | 0.04 |
| EHDP | 0.2 |
| $TiO_2$ | 0.1 |
| NaCl | 0.5 |
| $Na_2CO_3$ | 0.7 |
| Dye & Perfume | ~0.6 |
| Total Moisture | 35 |

*AB = Anhydrous Borax ($Na_2B_4O_7$).
**82/18 Soap

In order to establish whether water was being retained in the bars as a result of water structuring by Borax, applicants examined the moisture loss in each of the examples 1–5 through a 6 week storage stability study.

Example 6 - 58% TFM, 0.9% AB, 10% Talc, 24% Moisture

| Ingredient | % by Wt. |
|---|---|
| Anhydrous Soap** | 63 |
| AB* | 0.9 |
| Talc | 10 |
| EDTA | 0.04 |
| EHDP | 0.2 |
| $TiO_2$ | 0.1 |
| NaCl | 0.5 |
| Na $CO_3$ | 0.7 |
| Dye & Perfume | ~0.6 |
| Total Moisture | 24 |

*AB = Anhydrous Borax ($Na_2B_4O_7$).
**82/18 Soap

| Example 7 - 38% TFM, 9.54% AB, *15% Sodium Lactate. 32% Moisture | |
|---|---|
| Ingredient | % by Wt. |
| Anhydrous Soap** | 41.4 |
| AB* | 9.54 |
| Talc | 0 |
| Sodium Lactate | 15 |
| EDTA | 0.04 |
| EHDP | 0.2 |
| $TiO_2$ | 0.1 |
| NaCl | 0.5 |
| Na $CO_3$ | 0.7 |
| Dye & Perfume | ~0.6 |
| Total Moisture | 32 |

*AB = Anhydrous Borax ($Na_2B_4O_7$).
**82/18 Soap

Control

In addition to the 7 examples of the invention, applicants also tested as controls (1) Breeze® Bar with 9% moisture, and a Lever 2000 Bar with 10% moisture. Compositions for these 2 are set forth below:

| Breeze | |
|---|---|
| Ingredient | % by Wt. |
| Anhydrous Soap* | 78 |
| Talc | 11 |
| EDTA | 0.04 |
| EHDP | 0.2 |
| $TiO_2$ | 0.1 |
| NaCl | 0.5 |
| Na $CO_3$ | 0.7 |

-continued

| Breeze | |
|---|---|
| Ingredient | % by Wt. |
| Dye & Perfume | ~0.6 |
| Total Moisture | 9 |

*82/18 soap

| Lever 2000 | |
|---|---|
| Ingredient | % by Wt. |
| Anhydrous Soap* | ≈52.0 |
| Sodium Cocoyl Isethionate | ≈21.0 |
| Sodium Isethionate | ≈6.0 |
| Free Fatty Acid | ≈8.0 |
| EDTA | 0.06 |
| EHDP | 0.03 |
| $TiO_2$ | ≈0.5 |
| NaCl | ≈0.5 |
| BHT | ≈.02 |
| Dye & Perfume | ≈2.0 |
| Total Moisture | ≈10.0 |

*82/18 soap

Example 8

Moisture Retention Studies

A. Sorption Measurements

The equilibrium moisture has been established for examples 1–5 and two controls (Breeze and Lever 2000) at ambient temperature and constant relative humidities (55%–95% RH) in a 6 week study. Table 2 shows the data from Sorption Measurements. The sorption isotherms have been plotted from this data.

TABLE 2

Data from Sorption Measurements.

| S. No. | Prototype | % M Initial | 55% RH Av. | 68% RH Av. | 76% RH Av. | 86% RH Av. | 95% RH Av. |
|---|---|---|---|---|---|---|---|
| 1 | Example 1 | 23 | 23 | 20 | 21 | 22 | 24 |
| 2 | Example 2 | 27 | 20 | 24 | 24 | 25 | 28 |
| 3 | Example 3 | 34 | 29 | 29 | 30 | 31 | 35 |
| 4 | Example 4 | 33 | 28 | 29 | 30 | 31 | 36 |
| 5 | Example 5 | 35 | 29 | 30 | 31 | 33 | 38 |
| 6 | Breeze | 9 | 9 | 9 | 9 | 9 | 10 |
| 7 | Lever 2000 | 10 | 10 | 10 | 10 | 11 | 14 |

The sorption measurements clearly show that high moisture containing Borax toilet soap bars retain moisture very well. It is important to note that Breeze and Lever 2000 with 9% and 10% initial moisture are already at their equilibrium moisture levels.

B. Storage Stability Tests.

Two types of storage stability tests have been done for examples 1–5 and two controls (same as above) under (a) ambient conditions (22° C.) for 6 weeks and (b) recycling conditions: alternating 80° F., 80% RH one week, ambient temperature next week, for 6 weeks. Both these tests show that high moisture containing soaps possessing Borax retain water very well even in 6 weeks.

TABLE 3

Total Weight Loss Under Ambient Storage Conditions

| Example | Bar Description | Initial Weight | % Total Weight Loss (2 Bar Average) Wk #1 | Wk #2 | Wk #3 | Wk #4 | Wk #5 | Wk #6 |
|---|---|---|---|---|---|---|---|---|
| Example 1 | 58% TFM, 3.7% AB, 7% Talc, 24% Moisture | 79 g | −5.1 | −6.4 | −7.3 | −7.9 | −8.3 | 8.5 |
| Example 2 | 55% TFM, 5.3% AB, 5% Talc, 28% Moisture | 79 g | −5.7 | −7.1 | −8.1 | −8.7 | −9.1 | 9.5 |
| Example 3 | 51% TFM, 9.54% AB, 0% Talc, 33% Moisture | 79 g | −7.0 | −8.5 | −9.6 | −10.2 | −10.6 | 11 |
| Example 4 | 47% TFM, 9.54% AB, 2% Na Lactate, 35% Moisture | 79 g | −7.4 | −9.0 | −9.9 | −10.6 | −11 | 11.3 |
| Example 5 | 49% TFM, 9.54% AB, 2% Glycerol, 33% Moisture | 79 g | −6.7 | −8.1 | −9.0 | −9.7 | −10 | 10.3 |
| Control | Breeze | 90 g | −0.1 | −0.1 | −0.1 | −0.2 | −0.3 | 0.3 |
| Control | Lever 2000 | 138 g | −0.1 | −0.1 | −0.1 | −0.2 | −0.2 | 0.3 |

TABLE 4

Total Weight Loss Under Recycling Storage Conditions*

| Example | Bar Description | Initial Weight | % Total Weight Loss (2 Bar Average) Wk #1 | Wk #2 | Wk #3 | Wk #4 | Wk #5 | Wk #6 |
|---|---|---|---|---|---|---|---|---|
| Example 1 | 58% TFM, 3.7% AB, 7% Talc, 24% Moisture | 79 g | −5.2 | −6.5 | −7.2 | −7.8 | −8.0 | −8.5 |
| Example 2 | 55% TFM, 5.3% AB, 5% Talc, 28% Moisture | 79 g | −5.8 | −7.2 | −8.1 | −8.6 | −8.9 | −9.3 |
| Example 3 | 51% TFM, 9.54% AB, 7% Talc, 33% Moisture | 79 g | −7.5 | −9.0 | −9.9 | −10.5 | −10.8 | −11.2 |
| Example 4 | 47% TFM, 9.54% AB, 2% Na Lactate, 35% Moisture | 79 g | −7.4 | −8.9 | −9.8 | −10.4 | −10.7 | −11.1 |
| Example 5 | 49% TFM, 9.54% AB, 2% Glycerol, 33% Moisture | 79 g | −6.7 | −8.0 | −8.9 | −9.4 | −9.6 | −10 |
| Control | Breeze | 90 g | −0.1 | −0.1 | −0.2 | −0.2 | −0.2 | −0.2 |
| Control | Lever 2000 | 138 g | −0.1 | −0.1 | −0.2 | −0.2 | −0.2 | −0.3 |

*Alternating 80° F., 80% RH one week; Ambient temperature one week.

Thus, sorption measurements show that Borax containing toilet soap bars retain the moisture very well (Table 2). Similarly, Storage Stability Studies (Tables 3 and 4), also show that the Borax containing soap bars retain 85–95% of initial moisture after six weeks under either ambient or recycling conditions.

Therefore, both these studies suggest that Borax is structuring water in the bar.

Example 9

The bars of the invention were tested using a penetrometer as described in the protocol above and results are as set forth below.

TABLE 5

Hardness of Borax Bars

| Code | Bar Description | Hardness (expressed as penetration value) |
|---|---|---|
| Control | Breeze (78% TFM, 11% Talc, 9% Moisture) | 5.0 |
| Example 1 | 58% TFM, 3.7% AB, 7% Talc, 24% Moisture | 5.1 |
| Example 2 | 55% TFM, 5.3% AB, 5% Talc, 28% Moisture | 5.4 |
| Example 3 | 51% TFM, 9.54% AB, 0% Talc, 33% Moisture | 5.7 |
| Example 4 | 47% TFM, 9.54% AB, 2% Sodium Lactate, 35% Moisture | 5.8 |
| Example 5 | 49% TFM, 9.54% AB, 2% Glycerol, 33% Moisture | 5.9 |

As clearly seen from Table above, bars of invention all have hardness (expressed as penetration value) less than or equal to 8, preferably less than or equal to 7, more preferably 4–6.

What is claimed is:

1. A personal wash bar composition comprising:

(a) 30% to 70% by wt. of a surfactant selected from the group consisting of fatty acid soap, anionic surfactant other than soap, amphoteric surfactant, nonionic surfactant and mixtures thereof;

wherein at least 30% of the surfactant system comprises anhydrous soap;

(b) 0.1% to 25% by wt. of a borate compound;

(c) about 20% by wt. to 60% by wt. water structured by borax;

wherein said bar contains no enzymes;

wherein said bar has hardness expressed as penetration value of less than or equal to 8 as measured by penetrometer test; and wherein said bar is made using a step in which ingredients used to form said bar are milled, plodded and stamped.

2. A composition according to claim 1, wherein surfactant system is 30–60% of bar composition.

3. A composition according to claim 1, wherein soap comprises at least 50% of surfactant system.

4. A composition according to claim 1, wherein bar has hardness expressed as penetration value less than or equal to 7.

5. A composition according to claim 1, wherein bar has hardness expressed as penetration value of 4–6.

* * * * *